United States Patent [19]

Goddard et al.

[11] Patent Number: 4,904,113

[45] Date of Patent: Feb. 27, 1990

[54] HIGHWAY EDGEDRAIN

[75] Inventors: James B. Goddard, Powell, Ohio; Leon H. Zimmerman, Nashville, Tenn.; Larry L. Martin, Hamilton, Ohio

[73] Assignee: Advanced Drainage Systems, Inc., Columbus, Ohio

[21] Appl. No.: 86,678

[22] Filed: Aug. 18, 1987

[51] Int. Cl.[4] ..... E02B 11/00

[52] U.S. Cl. ..... 405/45; 138/121; 405/49; 404/2

[58] Field of Search ..... 405/36, 43, 45, 49, 405/50; 52/630; 138/115, 116, 119, 121, 173, 177, DIG. 8, DIG. 11; 285/424; 404/2

[56] References Cited

U.S. PATENT DOCUMENTS

| | | | |
|---|---|---|---|
| 1,979,804 | 11/1934 | Lutz | 285/424 X |
| 3,241,609 | 3/1966 | Reznor | 138/173 X |
| 3,581,778 | 6/1971 | Korejwa et al. | 138/119 |
| 3,611,729 | 10/1971 | Stark | 405/49 |
| 3,976,578 | 8/1976 | Beane | 405/49 X |
| 4,045,964 | 9/1977 | Barclay | 405/50 |
| 4,140,422 | 2/1979 | Crumpler et al. | 405/49 |
| 4,220,423 | 9/1980 | Sivachenko | 52/630 X |
| 4,245,924 | 1/1981 | Fouss et al. | 405/45 |
| 4,490,072 | 12/1984 | Glasser | 405/45 |
| 4,523,613 | 6/1985 | Fouss et al. | 138/121 |
| 4,572,700 | 2/1986 | Mantarro et al. | 405/45 X |
| 4,574,541 | 3/1986 | Raidt et al. | 405/45 X |

FOREIGN PATENT DOCUMENTS

| | | | |
|---|---|---|---|
| 1074951 | 2/1984 | U.S.S.R. | 405/49 |
| 763690 | 12/1956 | United Kingdom | 138/121 |

*Primary Examiner*—David H. Corbin

*Attorney, Agent, or Firm*—Biebel, French & Nauman

[57] ABSTRACT

A hydraulic structure is provided in the form of a flexible, flat, corrugated plastic tube having a relatively oblongated cross-section, with apertures associated with the grooves of the corrugation. The tube is enclosed in a geotextile sheath. The two relatively flat sides or panels of the tube are separated from each other by a plurality of pairs of cuspations, which project inwardly from the panel surface. Cuspations from the opposing panels are secured to one another thereby providing increased structural integrity.

20 Claims, 4 Drawing Sheets

HIGHWAY EDGEDRAIN

FIELD OF THE INVENTION

This invention relates to a hydraulic structure, and more particularly to a flat tubular structure which preferably can be used as a highway edgedrain.

BACKGROUND OF THE INVENTION

This invention is directed to the providing of a suitable hydraulic structure which is designed to be utilized as a highway edgedrain. The United States of America's total investment in its highway system exceeds $200 billion dollars, with the greatest enemy to these highways being water. The presence of undesirable levels of water in the road sub-base aggravates the deterioration of the highway. The types of pavement distresses caused by water are quite numerous and vary depending on the type of pavement system. For flexible pavement systems, such as asphalt, some of the distresses related to water either alone or in combination with temperature include: potholes, loss of aggregates, raveling, weathering, alligator cracking, reflective cracking, shrinkage cracking, and heaves (from frost or swelling soils). For rigid pavement systems, such as concrete, some of the distresses include faulting, joint failure, corner cracking, diagonal cracking, transfer cracking, longitudinal cracking, shrinkage cracking, blow-up or buckling, curling, D-cracking, surface spalling, steel corrosion, and heaving (from frost or swelling soils). Since 1976, the U.S. Department of Transportation, Federal Highway Administration, has been conducting studies aimed at solving the water problem. Since 1977, the Transportation Research Board of the National Academy of Science has been involved in similar research efforts. Ongoing studies by both these organizations have attempted to address this serious problem.

Moisture in pavement systems can come from several sources. Moisture may permeate the sides, particularly where coarsegrained layers are present or where surface drainage facilities within the facility are inadequate. The water table may rise; this can be expected in the winter and spring season. Surface water may enter joints and cracks in the pavement, penetrate at the edges of the surface, or percolate through the surfacing and shoulders. Water may move vertically in capillaries or interconnected water films. Moisture may move in vapor form, depending on adequate temperature gradients and air-void space. Moreover, the problem of water pavement systems often becomes more severe in areas where frost action or freeze-thaw cycles occur, as well as in areas of swelling soils and shales.

Once the sub-base becomes appreciably saturated, the highway literally is floating on a bed of saturated base material. The water problem is further aggravated by a phenomenon known as "pumping". The surface of a highway, whether it be of an asphalt or concrete composition, has a significant amount of force exerted on it by larger vehicles, such as semi-tractor trailers. This exertion of force actually causes the pavement to deflect slightly, wherever cracks or underlying voids are present with respect to asphalt roads, and wherever joints, faults or underlying voids are present with respect to concrete roads. This deflection of the pavement, however slight, causes a pumping movement with respect to the water trapped in the sub-base. Part of this pumping of water occurs laterally through the sub-base only, resulting in the washing away of fine soil particles, which over time significantly weakens the sub-base.

More important, however, is the movement of water immediately beneath the pavement surface. This movement of water tends to erode the area under the pavement, causing voids and ultimately leading to pavement failure. Additionally, the velocity of the water flow carries away small portions of the lower pavement surface. Studies by the French government have shown that the velocity of the water flow generated by "pumping" can reach up to 200 mph. Thus, the problems caused by water cannot be underestimated. An example of how acute these problems can become, is vividly shown by the fact that in 1981, the United States Congress launched a federal investigation into the deterioration of Interstate 10 in Florida, which had been destroyed within 6 years of its date of installation by the interaction of water with the road surface.

Recognition of the problem water poses for roads is not new. However, the two traditional approaches to the problem, i.e. better methods of sealing the road surface, and improved structural design of the pavement, have proved futile in combatting roadway deterioration. Thus, it has only been in recent years that attention has been directed to the merits of edgewater drainage.

The earliest attempts at trying to combat the problem of water through proper edgewater draining of highways commenced in earnest in the early 1970's, when sections of 4 inch round plastic pipe manufactured according to the teaching of Sixt, U.S. Pat. No. 3,699,684 were laid on top of a sheet of polypropylene fabric. The pipe was then covered with gravel, with the fabric then being folded over the gravel, and covered by a cement or asphalt cap. Other examples of subterranean drain design, such as Delattre, French Pat. No. 2,384,901, Healy et al., U.S. Pat. No. 3,654,765, Healy et al., U.S. Pat. No. 3,563,038 and Glasser et al., Great Brit. Pat. No. 2,056,236 were incapable of accommodating the flow present in highway edgedrains and thus proved of no help in solving the problem. Additionally, these drain designs are rigid and not bendable, thus requiring excavation of sufficiently long trenches so that an entire length of drain can be installed. Moreover, there is the problem of matting and lack of structural integrity. Finally, the surface area of the drain capable of being in direct contact with the sub-base for purposes of support was minimal due to the presence of the cylindrical conduit. The problem relating to surface area also confronted Sixt, U.S. Pat. No. 3,830,373 and was aggravated by the fact that the surface area for intercepting sub-surface water was limited to approximately the diameter of the conduit.

In approximately 1983, the Monsanto Corporation introduced its answer to the edgedrain problem in the form of its Hydraway ® edgedrain, a flexible composite product with fabric bonded to a polyethylene core. U.S. Pat. No. 4,572,700 was granted in connection with the Monsanto ® product. Other companies have attempted to provide strong, efficient hydraulic structures for use as highway edgedrains. Examples of other companies and their respective products include Burcan Manufacturing, Inc. and its Stripdrain TM and the American Wick Drain Corporation and its product, Akwadrain TM .

Unfortunately, all of these recent attempts at providing efficient hydraulic structures have resulted in products which are relatively fragile and have a tendency to encounter dimensional creep. Dimensional creep causes the hydraulic structure to slowly move vertically when horizontal stress is applied, thereby sacrificing structural integrity and forming voids. Dimensional creep exacerbates problems with matting, as well as accelerating roadway deterioration. Further, they often utilize fabric which, depending on the adjoining soil, may become blinded with soil particles or may allow too much material to pass through resulting in loss of sub-base support. Additionally, due to their structure, their fabric has a tendency to mat down, thereby blocking flow channels and causing a decreased flow capability. Furthermore, they are characterized by a labyrinth-like staggered flow channel, as opposed to one which is essentially free-flowing.

SUMMARY OF THE INVENTION

In accordance with this invention, a hydraulic structure is provided for use preferably as a highway edgedrain. The structure of this invention is formed from an oblongated plastic core or shell that can be fabricated in a thickness suitable for attaining the necessary structural strength. The plastic core is configured as a relatively flat tube and inserted into a fabric sheath. Preferably, this fabric sheath of a nonwoven fabric wrap will have a geotextile composition. In the preferred embodiment of the invention, the plastic core is corrugated, with a plurality of apertures present in the grooves associated with the corrugation. The recessed grooves act as channels to rapidly accommodate any water excreted by the adjacent sub-base, while the flat surface of the ridges approximates a planar exterior surface for the portion of the tube directly adjacent to the pavement and sub-base.

Additionally, a plurality of cuspations project inwardly from the relatively flat two opposing panels of the oblongated tube to provide structural integrity as well as to eliminate the problems with creeping encountered in the prior art. The cuspations permit the hydraulic structure to remain in intimate contact with the edge of the pavement and sub-base. The geotextile sheath is continuous about the tube, with the sheath being secured to itself by appropriate fastening means. The sheath acts as a filter to prevent the passage into the hydraulic structure of relatively large particles or rocks which would decrease flow capability.

The primary objective of this invention is to provide a highway edgedrain that is of extremely economical construction and is particularly easy to install and maintain in functional, operational relationship to the sub-base and pavement of a highway. Important aspects of this objective are the forming of an edgedrain which is extremely effective in facilitating the removal of water from beneath the pavement and from within the sub-base. This important objective is furthered by the corrugations of the pipe which serve as channels, as well as the plurality of apertures within the grooves of the corrugations which facilitate the passage of water into the hydraulic structure.

Another important objective is the fabrication of a highway edgedrain which will resist dimensional creep. This important objective is furthered by the presence of the inwardly projecting cuspations which serve to provide support for the opposing relatively planar side panels of the hydraulic structure. This important objective is also furthered by the relatively planar side panels of the hydraulic structure which are in direct contact with the edge of the pavement and sub-base.

Another objective of this invention is to provide a hydraulic structure which overcomes problems with decreased flow area due to problems with matting. This important objective is furthered by the corrugations which serve to hold the sheath in a supported and yet spaced relation with the apertures. This objective is also furthered by completely enclosing the flow area in plastic, thereby preventing the possibility of the geotextile fabric becoming clogged and congesting the flow area.

These and other objects and advantages of this invention will be readily apparent from the following detailed description of an illustrative embodiment thereof. Reference will be had to the accompanying drawings which illustrate the preferred embodiment of the invention.

DESCRIPTION OF THE DRAWING FIGURES

Figure 4:
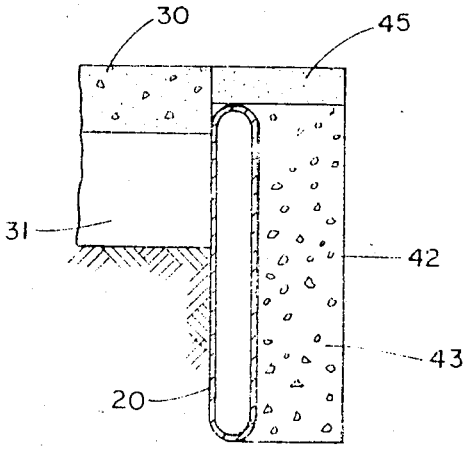

FIG. 4 discloses our new invention as positioned for actual use.

Figure 5:
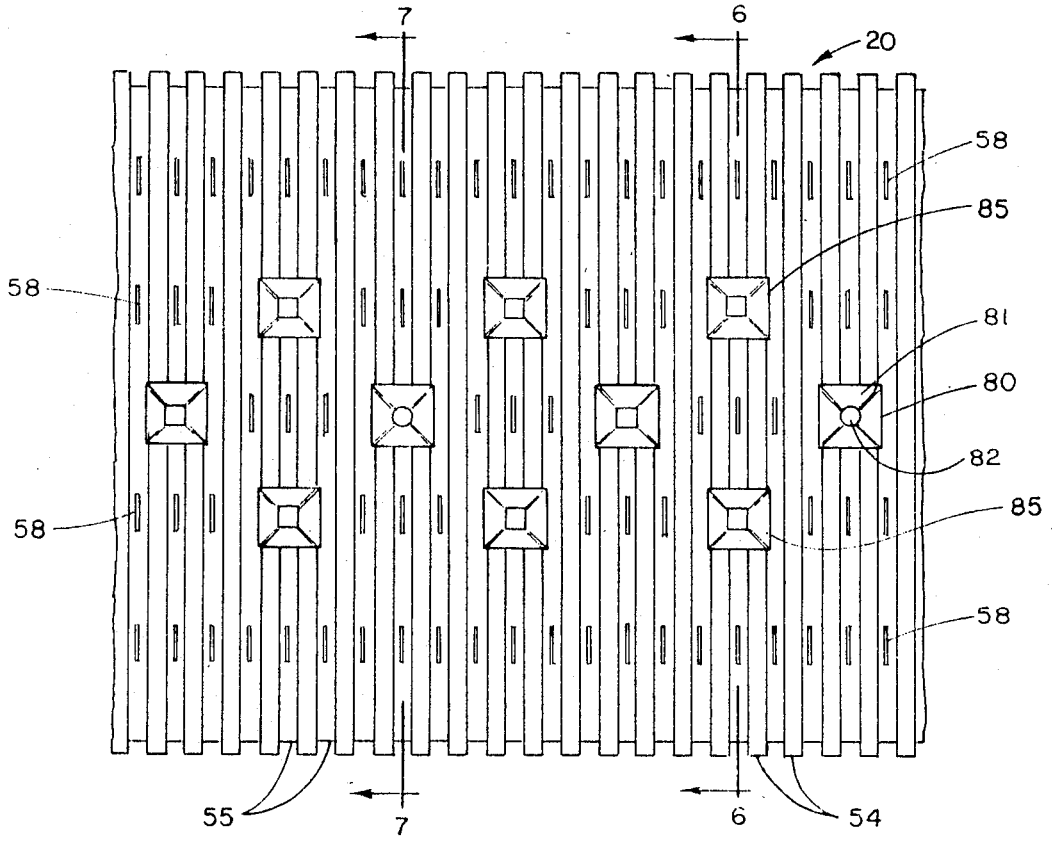

FIG. 5 is a fragmentary side view of the preferred embodiment of the invention.

Figure 6:
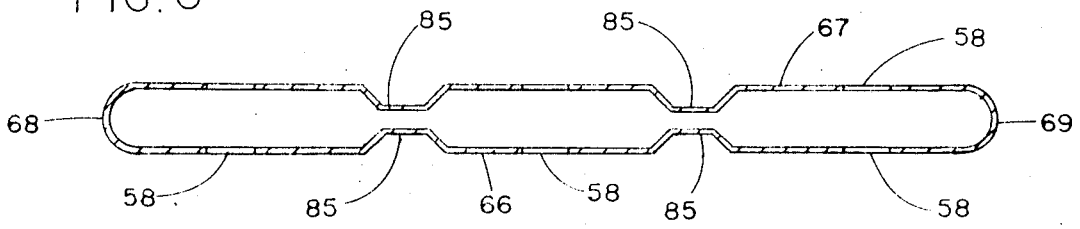

FIG. 6 is a vertical sectional view on a greatly enlarged scale taken along line 6—6 of FIG. 5.

Figure 7:
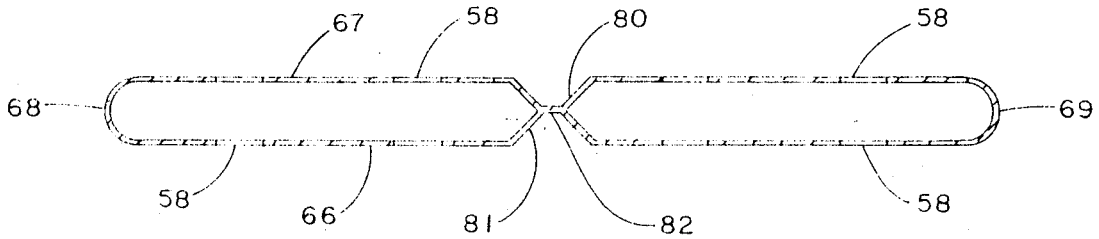

FIG. 7 is a vertical sectional view on a greatly enlarged scale taken along line 7—7 of FIG. 5.

Figure 8:
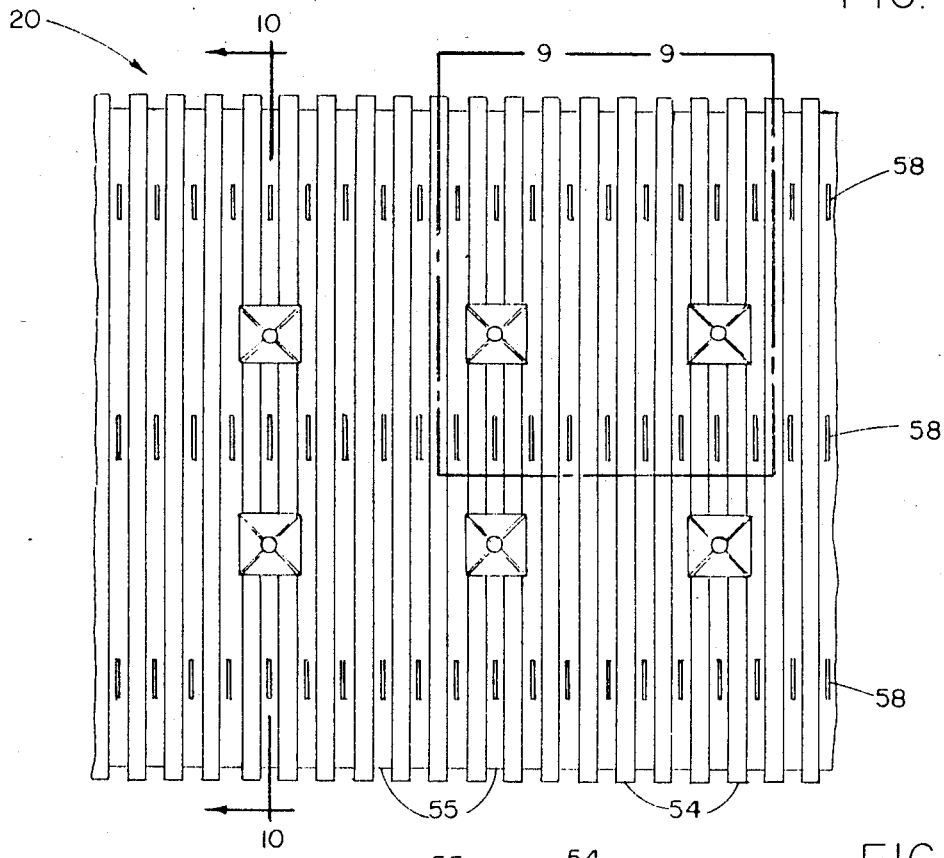

FIG. 8 is a fragmentary side view of a modified structure of the invention.

Figure 9:
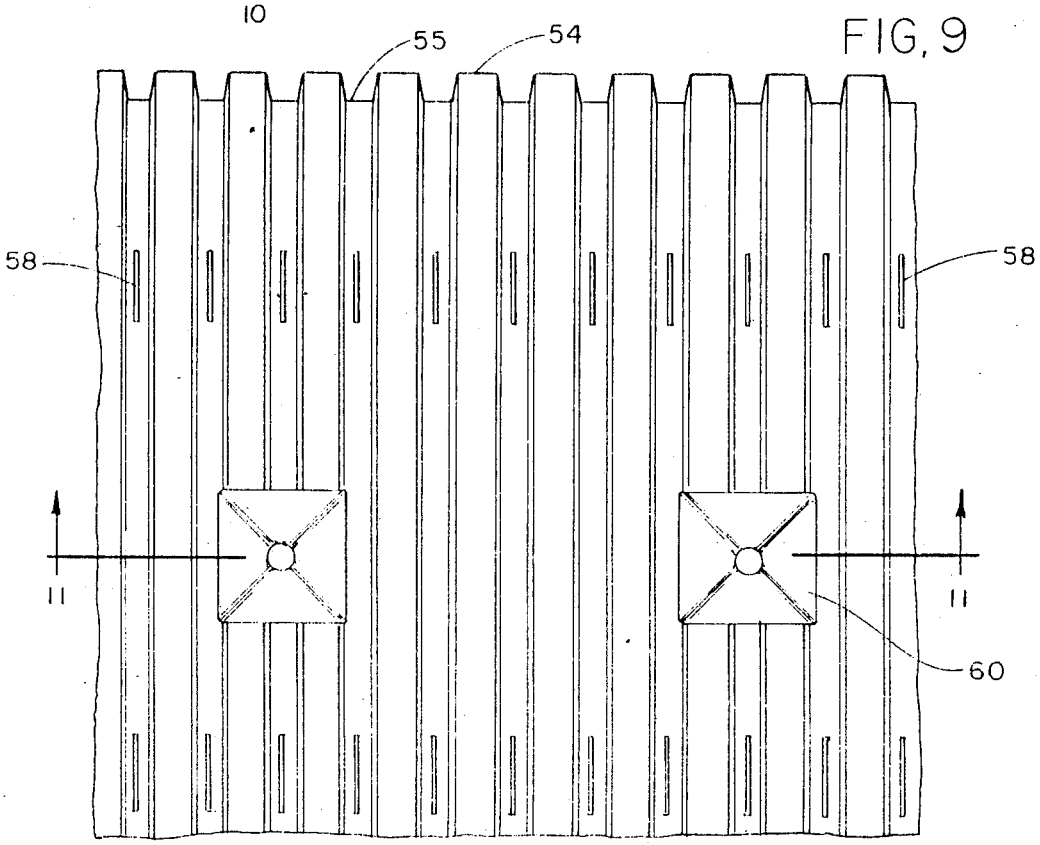

FIG. 9 is a fragmentary side view on a greatly enlarged scale showing the area enclosed by line 9—9 of FIG. 8.

Figure 10:
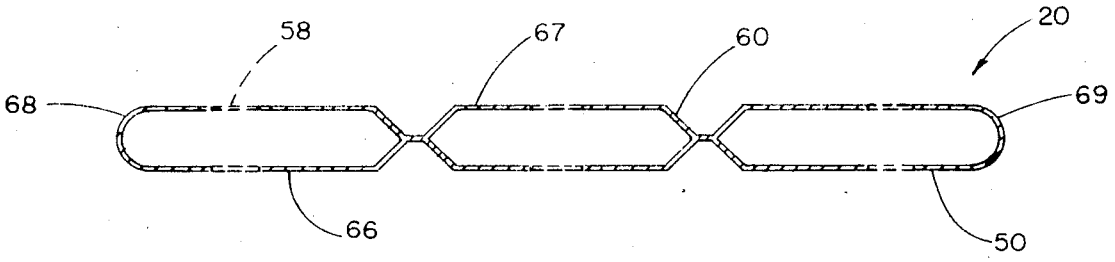

FIG. 10 is a vertical sectional view on a greatly enlarged scale taken along line 10—10 of FIG. 8.

Figure 11:
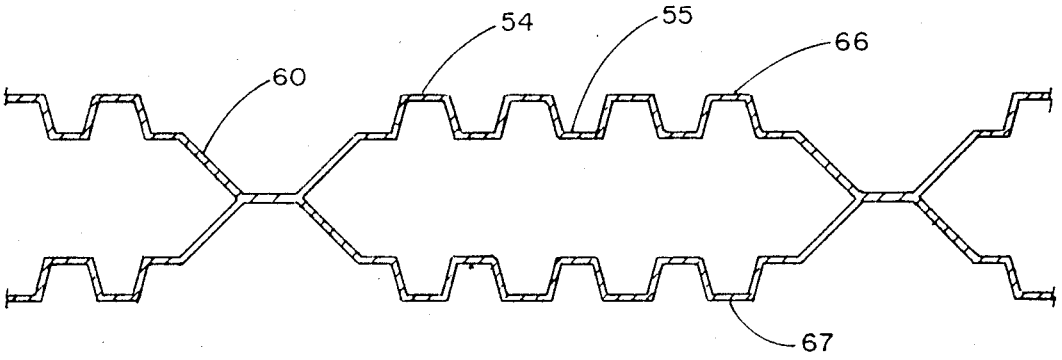

FIG. 11 is a fragmentary horizontal sectional view taken along line 11—11 of FIG. 9.

DESCRIPTION OF THE ILLUSTRATIVE EMBODIMENT

Figure 1:
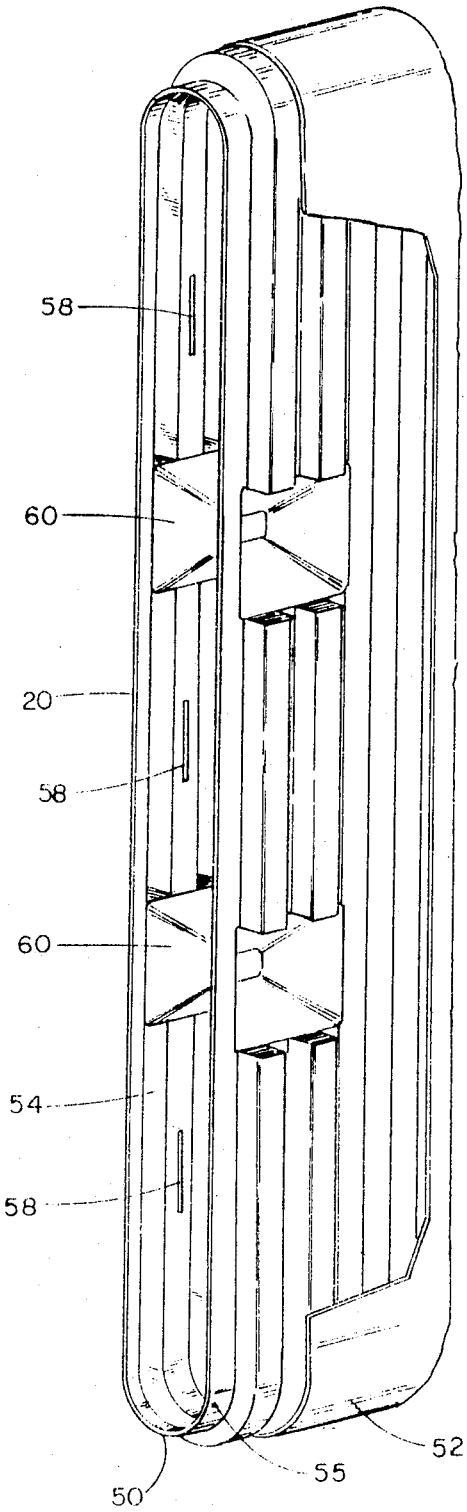
FIG. 1 is a fragmentary front perspective view of a hydraulic structure embodying our new invention with a portion of the geotextile sheath shown removed in order to facilitate a better understanding of our new invention.
Figure 2:
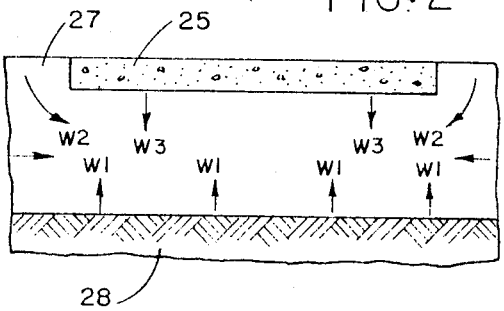
FIG. 2 is a diagrammatic drawing showing the sources of water in roadbeds.

Having reference to the drawings, attention is directed first to FIG. 1 which illustrates a hydraulic structure embodying this invention designated generally by the numeral 20. To best appreciate the improvement associated with this edgedrain 20, it is necessary to consider the conditions under which this structure is designed to operate. FIG. 2 discloses the existence of a highway 25 surrounded on three sides by subgrade soil 27. Although highway 25 is supported by subgrade soil 27, ultimately a ground water table 28 exists at some depth below highway 25. Water problems occur beneath the highway due to three sources of water designated as W-1, W-2 and W-3. Some water will rise from ground water table 28 by means of capillary action as shown by W-1. Other water during times of precipitation will pass into the subgrade soil beneath highway 25 by means of lateral seepage as shown by W-2. Finally, some water will seep through cracks and joints in highway 25 and enter the subgrade soil as shown by W-3.

Figure 3:
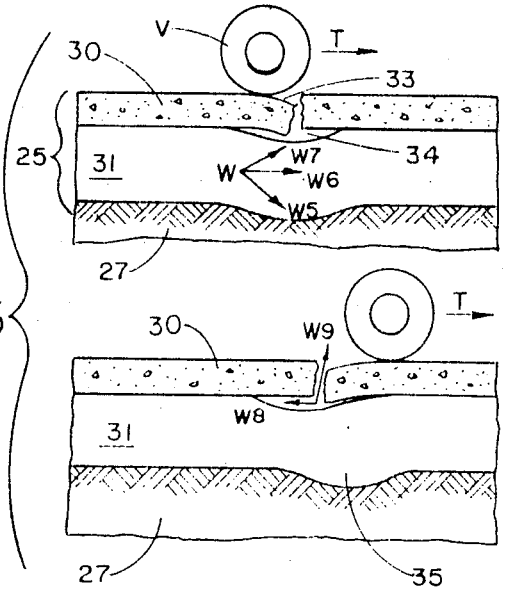
FIG. 3 is a diagrammatic drawing showing the affect of pumping action on a roadbed.

The problem which this invention addresses is diagrammatically shown in FIG. 3 which shows the effect of a heavy vehicle on the highway 25 and more particularly to the highway pavement 30 and sub-base 31. As the upper portion of FIG. 3 shows, vehicle V moving in direction T will by nature of the vehicle weight, depress portions of the pavement wherever there is a fault 33 or cavity 34. The depression of pavement 30 along fault line 33 causes some deterioration of the pavement surface. However, the real damage to the road is caused by the underlying effect of water as shown by water movement W-5, W-6 and W-7. The weight associated with vehicle V when the portion adjacent the fault is initially depressed forces water downwardly through the sub-base towards the subgrade soil. Additionally, some water is forced laterally in direction W-6 parallel to the road surface. Other water is forced in direction W-7 such that cavity 34 becomes filled with some of the water force associated with W-7, thereby eroding small particles from the lower surface of pavement 30.

As vehicle V travels in direction T across fault line 33, a portion of the pavement previously depressed returns towards its original position, while the portion of the pavement immediately beyond the fault line now becomes depressed as shown in the lower portion of FIG. 3. Water previously directed downward by force W-5 is now subjected to extreme downward pressure at this point which over time results in the creating of a depression 35. This depression allows portions of sub-base 31 to pull away from the lower surface of pavement 30, thereby causing a greater volume to be associated with cavity 34. Additional water force is directed into the portion of the cavity formerly filled by the depressed pavement. This force of water W-8 causes additional fine particles on the lower surface of the pavement to erode. The rapid contraction of cavity 34 by the passage over fault 33 of vehicle V will force water to spurt upwardly through the fault as shown by W-9. This rapid expulsion of water will be accompanied by particles originating from the pavement, as well as sub-base sediment. The abrasive action caused thereby additionally widens the fault 33, which in turn permits greater volumes of surface water to seep downward. Over time, cavity 34 will become larger and larger as the sub-base is removed from its position adjacent pavement 30 primarily by water forces W-5, W-6 and W-9. Eventually, pavement 30 will experience additional faulting as the pavement portions adjacent the fault line will break away due to a lack of support from the sub-base. In extreme cases, entire portions of a road may be engulfed in what is known as a sinkhole.

In accordance with this invention, an edgedrain 20 is designed to be positioned immediately adjacent the edge of pavement 30 and sub-base 31 as shown in FIG. 4. Normally, the pavement itself is approximately 9 inches thick with the sub-base being approximately 10 inches thick. The sub-base may be of a single material or may have the upper portion comprised of an aggregate bituminous base with the lower portion comprised of a lime sub-base. The edgedrain 20 is positioned in trench 42 such that its lower-most portion is a minimum of between 16 and 22 inches below the surface. Similarly, the edgedrain preferably extends between 11 ½ and 2 inches above the seam line associated with the pavement 30 and sub-base 31. Trench 42 then has fill 43 deposited on the opposite side of edgedrain 20 to ensure that the edgedrain is in intimate contact with the edge of the pavement and sub-base. Finally, a concrete, asphalt, or other aggregate cap 45 is placed along the length of the top of the trench.

In accordance with this invention, a highway edgedrain 20 is provided as can be seen in FIG. 1 with an external core 50 in the form of a longitudinally flexible corrugated tube encased in a porous fibrous sheath or web 52. Preferably, the tube is formed from extruded thermoplastic polymer such as polyethylene fabricated in a thickness suitable for obtaining necessary structural strength. In the preferred embodiment of this invention, the wall thickness is contemplated as being between 0.03 and 0.04 inches. The fibrous sheath 52 preferably is of a non-woven fabric wrap of a geotextile composition having a density of at least 3 ounces per square yard, similar to the product known as TYPAR, a trademarked product of Reemay, Inc., a spun bonded polypropylene fiber having a weight of approximately 3.5 ounces per square yard.

The corrugated structure of the tube can best be seen in FIGS. 5, 8 and 9, which show the various ridges 54 and grooves 55 associated with the corrugation. These ridges and grooves appear as alternating annular peaks and valleys with walls interconnecting them. In selected valleys 55 of the tube, a plurality of apertures 58 are arranged transversely to the longitudinal axis of the tube. Additionally the apertures are arranged in a plurality of rows with respect to the longitudinal axis of the tube.

A plurality of cuspations 60 project inwardly from opposite first and second panels 66 and 67 respectively. These cuspations serve as a means which extend between the side panels to provide internal support between the walls. These panels, along with rounded edges 68 and 69, provide the tube with an oblongate cross-sectional appearance as can be seen in FIG. 1. In the preferred embodiment shown in FIGS. 5–7, the cuspations are of two types. The first type of cuspations 80 are positioned along the longitudinal axis of the structure, and are of a polyhedral shape with a plurality of triangular faces 81. The base of the polyhedron is preferably a square with sides of a length of 1⅛ inch. Opposing cuspations are physically joined to one another at mold line 82, so as to secure panels 66 and 67 in fixed spatial relation to each other. The cuspations 80 project approximately ⅜ inch inwardly from the interior surface of each of said panels 66 and 67.

The preferred type of embodiment also utilizes a second type of cuspation 85, which has the appearance of a truncated polyhedral shape, with the truncation preventing the opposing cuspations of this second type from being secured to one another. The ratio of the number of this second type of cuspation to the first type is at least 2:1. At least one row of the second type of cuspation appears between the edges 68 and 69 and the center row of cuspations 80. Cuspations of this second type 85 can also be positioned along the longitudinal axis of the structure, being interspersed with cuspations of the first type 80. The tube is thus coilable about the axis parallel to the corrugations. Moreover the structure is structurally continuous and rigid in directions perpendicular.

In this preferred embodiment the cuspations are arranged in a plurality of rows, with adjacent rows being offset from each other. The distance between adjacent rows is approximately 1¾ inches, such that the top and bottom rows are positioned 4⅝ inches apart. With respect to the cuspations in each row, they are separated by approximately 2⅝ inches. In the center row, cuspations of the first type 80 are positioned approximately 6⅝ inches from each other. Thus, the distance between any two cuspations of the first type 80 is greater than the distance between any adjacent cuspations, wherein at least one is of the second type 85.

In an alternative embodiment, shown in FIGS. 8–11, there are fewer rows of cuspations, with all of the cuspations resembling one another. FIGS. 8–11 show all cuspations as being the first type of cuspations 80 of the preferred embodiment. All of these cuspations are shown as being positioned in opposing relationship.

In both embodiments, the means of support 60 are provided at intervals along the length of the tube. The cuspations 60 are oriented such that the two panels have an identical number of cuspations occurring in pairs, preferably located opposite one another.

With the height of the preferred tube 50 being approximately 12 inches, the height associated with said panels 66 and 67 is greater than the distance between said panels which is on the order of greater than 1 inch. The ratio between the height and the distance between the panels is greater than 2.5:1. The ratio of the height of the tube in inches to the number of rows of cuspations is greater than or equal to 3.5:1.

As can be seen in FIG. 8, the ridges or annular peaks and grooves or valleys alternate with one another with walls interconnecting said peaks and valleys. In the preferred embodiment of the invention, the annular peaks are of a height of approximately ⅜ inch and are in the shape of a trapezoid. The upper surfaces of the peaks are flat such that panels 66 and 67 assume a relatively flat configuration. The dimensions associated with the width of the valleys is approximately the same as the dimensions associated with the width of the peaks. These alternating peaks and valleys form a plurality of channels for receiving and transporting of fluids to the apertures at which locations the flow enters the interior of the tube and passes along a plastic lined flow channel formed in part by the inner surface wall of the tube. The peaks also serve to keep the fabric sheath in a spaced relation with the bottom of the channels and the apertures therein.

As can be seen in FIGS. 1 and 7, the first and second panels are secured to one another along the top and bottom of said panels throughout their entire length with said fibrous sheath being secured to itself by appropriate fastening means such as ultrasonic or hot-wire welding. The fibrous sheath which surrounds tube 50 thus is not secured to the outer surface of the tube itself. This has practical advantages in permitting easier installation of the corrugated tub in trenches since the fibrous sheath will not be stretched or deformed due to the manner in which the tubes are coiled for purposes of storage.

It will be readily apparent from the foregoing detailed description of illustrative embodiments of this invention that a particularly novel and extremely effective hydraulic structure is provided. This flexible corrugated tube structure is relatively simple to fabricate and requires minimal amount of time for installation in trenches adjoining highways for application as an edgedrain. The edgedrain results in an extremely effective product to transport water received a slow seepage as well as water received in high velocity pumping to a remote discharge point. The specific configuration of an outer structurally rigid shell of oblongate cross-section serves to permit the introduction of water into the hydraulic structure from two sides as well as providing a hydraulic structure which assists in the support of the edge of the sub-base and pavement. This assistance effectively slows the deterioration of the pavement and sub-base. The structure of this invention permits greater unobstructed fluid flow then is found in other currently known systems. The invention also has applications in other types of drainage, including agricultural and foundational, as well as along other paved or covered surfaces.

Having thus described this invention, what is claimed is:

1. A hydraulic structure comprising a flexible, corrugated tube having alternating annual peaks and valleys, said tube surrounded by a fibrous sheath said tube having first and second relatively flat opposing spaced corrugated panels said panels of said corrugated tube having a plurality of apertures in selected valleys of the tube arranged transversely to the longitudinal axis of the tube, and means extending between said panels within said tube for supporting said panels in a spaced relation, said means comprising inwardly projecting cuspations located on said first panel opposite cuspations on said second panel.

2. A hydraulic structure according to claim 1, wherein at least some cuspations of said first and second panels are secured to one another.

3. A hydraulic structure according to claim 1, wherein cuspations are in the shape of a polyhedron having a plurality of triangular faces.

4. A hydraulic structure according to claim 1, wherein said first and second panel are of the same dimension, with the height associated with said panels being greater than the distance between said panels.

5. A hydraulic structure according to claim 4, wherein the height associated with said panels is more than two and one-half times greater than the distance between said panels.

6. A hydraulic structure according to claim 1, wherein said tube is of an oblongate cross-section..

7. A hydraulic structure according to claim 6, wherein said apertures are of a rectilinear configuration having their longitudinal axes in the same plane as the longitudinal axes of said valleys.

8. A hydraulic structure according to claim 1, wherein said fibrous sheath is fabricated from a nonwoven fabric.

9. A hydraulic structure according to claim 8, wherein said sheath is fabricated from a geotextile material.

10. A hydraulic structure according to claim 9, wherein said geotextile material has a density which is greater than 3 ounces per square yard.

11. A hydraulic structure according to claim 8, wherein said first and second panels are secured to one another along the top and bottom of said panels throughout their entire length.

12. A hydraulic structure according to claim 8, wherein said sheath is continuous about said tube, being secured to itself by appropriate fastening means.

13. A hydraulic drain structure comprising a corrugated oblongate tube having a series of peaks and valleys, said tube having relatively flat opposed spaced corrugated panels, a plurality of apertures in the valleys of said spaced panels inwardly projecting means within said tube located on at least one of said spaced panels for supporting said panels in a spaced relation, and a continuous porous web disposed around said tube.

14. The hydraulic drain of claim 13 wherein said oblongate tube is elongated and is coilable about an axis parallel to the corrugations thereof, said tube being substantially rigid in directions perpendicular to said axis.

15. The hydraulic drain of claim 13 wherein said support means comprise spaced members secured between said panels.

16. A hydraulic drain comprising a corrugated oblongate tube having a series of peaks and valleys, said tube having relatively flat opposed spaced corrugated panels, inwardly projecting spaced support means within said tube located on at least one of said panels for supporting said panels in a spaced relation, said tube being elongated and coilable about an axis parallel to the corrugations thereof.

17. A hydraulic structure comprising a flexible, corrugated tube having alternating annular peaks and valleys, said tube having first and second relatively flat opposing spaced corrugated panels, and means extending between said panels within said tube for supporting said panels in a spaced relation, said means extending between said panels within said tube for supporting said panels in a spaced relation, said means comprising inwardly projecting cuspations located on at least one of said relatively flat opposing spaced corrugated panels.

18. A hydraulic structure according to claim 17, wherein at least one of said panels of said corrugated tube have a plurality of apertures in selected valleys of the tube arranged transversely to the longitudinal axis of the tube.

19. A hydraulic structure according to claim 18 wherein said tube is surrounded by a fibrous sheath.

20. A hydraulic structure according to claim 17, wherein said tube is of an oblongate cross-section.

* * * * *